US006793471B2

(12) United States Patent
Latyshev

(10) Patent No.: US 6,793,471 B2
(45) Date of Patent: Sep. 21, 2004

(54) FLUID MACHINE

(76) Inventor: Sergei Latyshev, Jasmin alley 2/6, Jerusalem (IL)

( * ) Notice: Subject to any disclaimer, the term of this patent is extended or adjusted under 35 U.S.C. 154(b) by 0 days.

(21) Appl. No.: 10/140,983

(22) Filed: May 9, 2002

(65) Prior Publication Data

US 2003/0210996 A1 Nov. 13, 2003

(51) Int. Cl.[7] ..... F04B 19/02; F04B 27/06
(52) U.S. Cl. ..... 417/460; 417/545
(58) Field of Search ..... 417/460, 416–419, 417/545, 547, 488

(56) References Cited

U.S. PATENT DOCUMENTS 4,589,328 A * 5/1986 Irwin ..... 91/489
4,629,026 A * 12/1986 Estela Rosell ..... 180/148
6,032,622 A * 3/2000 Schmied ..... 123/42
6,457,957 B1 * 10/2002 Bauer et al. ..... 417/562

FOREIGN PATENT DOCUMENTS

FR EP 02 284 450 A1 * 9/1988
JP 2001-63939 * 3/2001
WO WO 00/77366 A1 * 12/2000

* cited by examiner

*Primary Examiner*—Justine R. Yu
*Assistant Examiner*—Han L Liu

(57) ABSTRACT

The fluid machine can be used as a pump, compressor, motor and internal combustion engine and is characterized by two mobile opposite cylinders fixed rigidly to each other. Said cylinders move simultaneously in the same direction. Inside the opposite cylinders there are two fixed opposite pistons rigidly secured to the housing and each said piston is made with suction and discharge valves designed to connect the working cavity between the corresponding piston and cylinder with low and high pressure sources.

Within one cycle of the reciprocating movements of opposite cylinders (direct and back) the liquid is twice sucked into cylinder chambers from the low pressure source and is supplied twice under pressure to the high pressure source.

1 Claim, 4 Drawing Sheets

FLUID MACHINE

BACKGROUND OF THE INVENTION

1. Field of the Invention

The present invention relates to a fluid machine that can be used as a pump, compressor, motor, transforming pressure from a high pressure source to a reciprocating or rotary movement, or as internal combustion engines if they are equipped with ignition and gas distribution systems.

2. Description of the Related Art

There are various designs of fluid machines (See, for instance, German Patents Nos. 1946149, 2128066, 2558960 and U.S. Pat. Nos. 2,366,186, 3,946,706) in which the reciprocating movement is carried out by opposite pistons. There are design of fluid machine U.S. Pat. No. 4,589,328 in which opposite pistons and opposite cylinders is situated on rotate able members and carry out rotating and reciprocating movement. There are various design of fluid machine in which the reciprocating movement is carried out by opposite cylinders:

- WO 00/77366 A1 in which two mobile cylinders are fixed to each other in the area of the central transverse section and carry out reciprocating movements relative to stationary pistons fixed to opposite sections of the housing. Heads of said pistons are directed towards each other. Working cavities between corresponding pistons and cylinders are interconnected through transfer ports and conduits which are situated in the mobile cylinder.
- U.S. Pat. No. 6,032,622 in which dual (opposite) mobile cylinders are mounted on an elongated shaft cam (pin). The shaft cam (pin) is situated between transverse cylinders parts. Said cylinders carry out reciprocating movement relative to stationary pistons fixed to opposite parts of the housing. Heads of said pistons are directed towards each other.
- JP 2001-63939 in which mobile cylinder apparatus (barrel) carries out reciprocating movements relative to a stationary piston. Two hollow rods, which pass through working cavities and holes in the walls of cylinder chambers and are fixed outside to stationary supports, go away from the piston in opposite directions.
- U.S. Pat. No. 4,629,026 in which a mobile cylinder assembly carries out reciprocating movements relative to a stationary piston. Two hollow rods, which pass through working cavities and holes in the walls of cylinder chambers and are fixed outside to opposite end walls of the housing, go away from the piston in opposite directions.
- EPO 284450 A1 in which a mobile cylinder carries out reciprocating movement relative to a stationary piston. The piston-rod passes through a working cavity and through holes in the wall of the cylinder chamber and is fixed outside to a stationary support.

Known also are fluid machine (compressor) (See U.S. Pat. No. 3,910,729) in which there are two mobile opposite cylinders embracing two fixed opposite pistons. The cylinders move simultaneously in opposite direction. In said design cylinders are not fastened to each other, which does not allow to use said design as a motor or as an internal combustion engine. These designs possess a number of shortcomings such as low efficiency, low output, low life and high cost.

SUMMARY OF THE INVENTION

It is a general object of the present invention to provide a fluid machine with more efficiency, more output, bigger life, more energy saving and less expensive, than currently used pumps, compressors, motors and engines. This object is provided in the present fluid machine that comprises a housing and two mobile opposite cylinders fixed rigidly to each other; transverse closed parts of said cylinders are situated on their outside ends; said cylinders carrying out reciprocating movements which occur always simultaneously in the same direction; two stationary opposite pistons are fixed to each other in the area of their skirts and from there rods, passing through holes in the walls of opposite cylinders outside the limits of working cavities, are rigidly secured to said housing; the heads of said pistons are directed outside from each other and made with a suction valve and a discharge valve designed to connect non-interconnected working cavities between the corresponding piston and cylinder with low and high pressure sources.

DETAILED DESCRIPTION OF THE PREFERRED EMBODIMENTS

Figure 1:
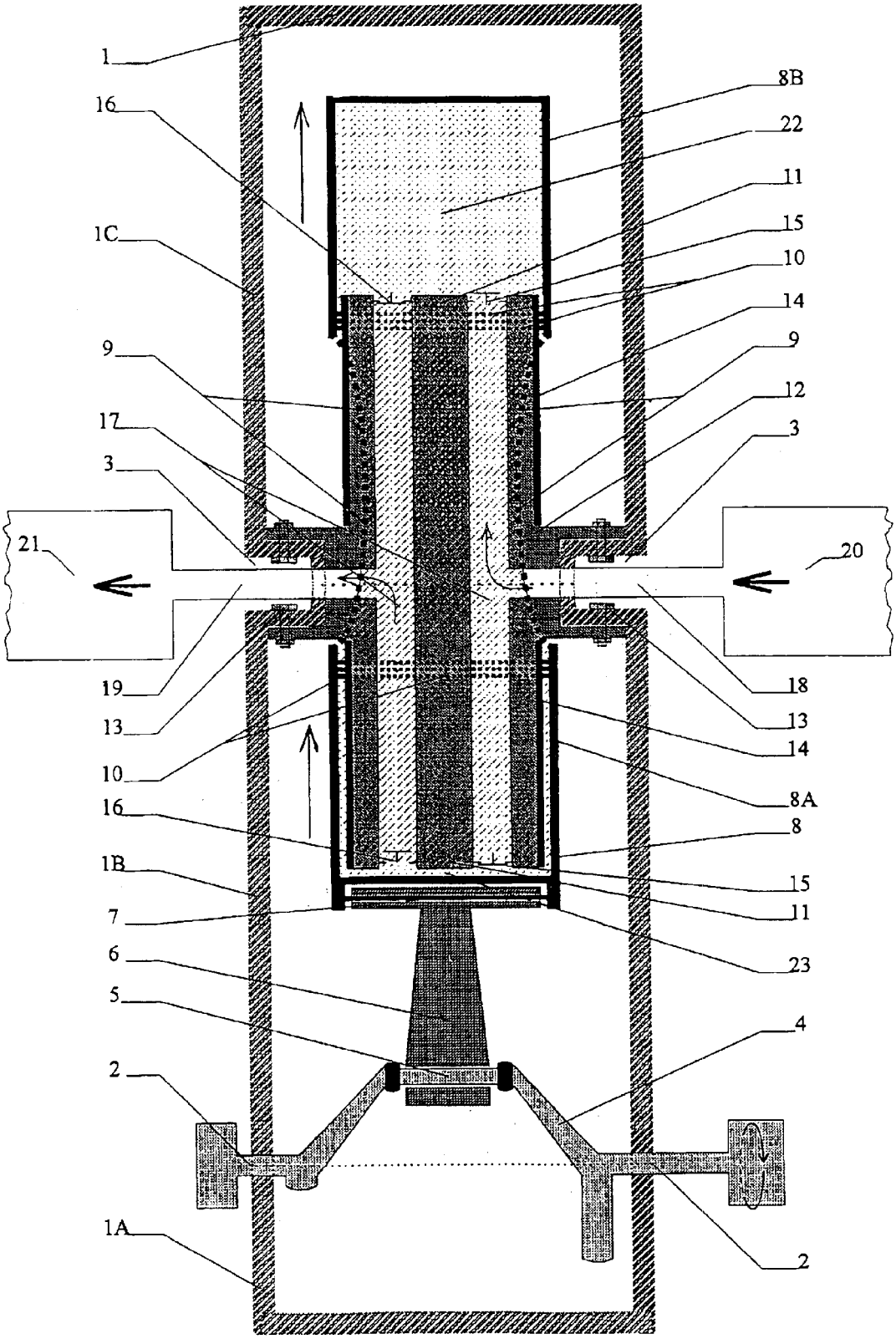
FIG. 1 is a sectional view of the piston pump made in keeping with the present invention.
Figure 2:
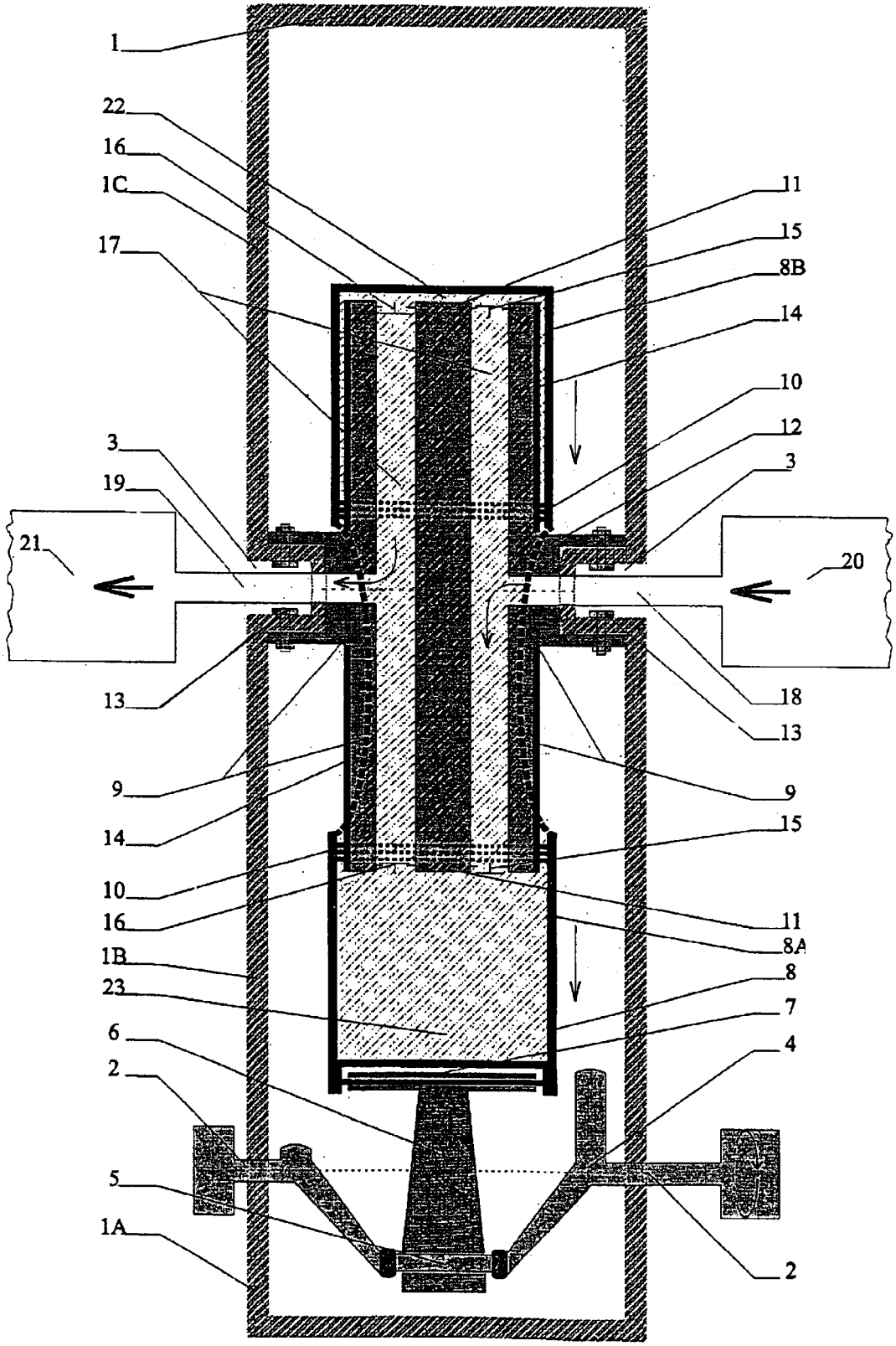
FIG. 2 is a sectional view of said pump in another stage of operation.
Figure 3:
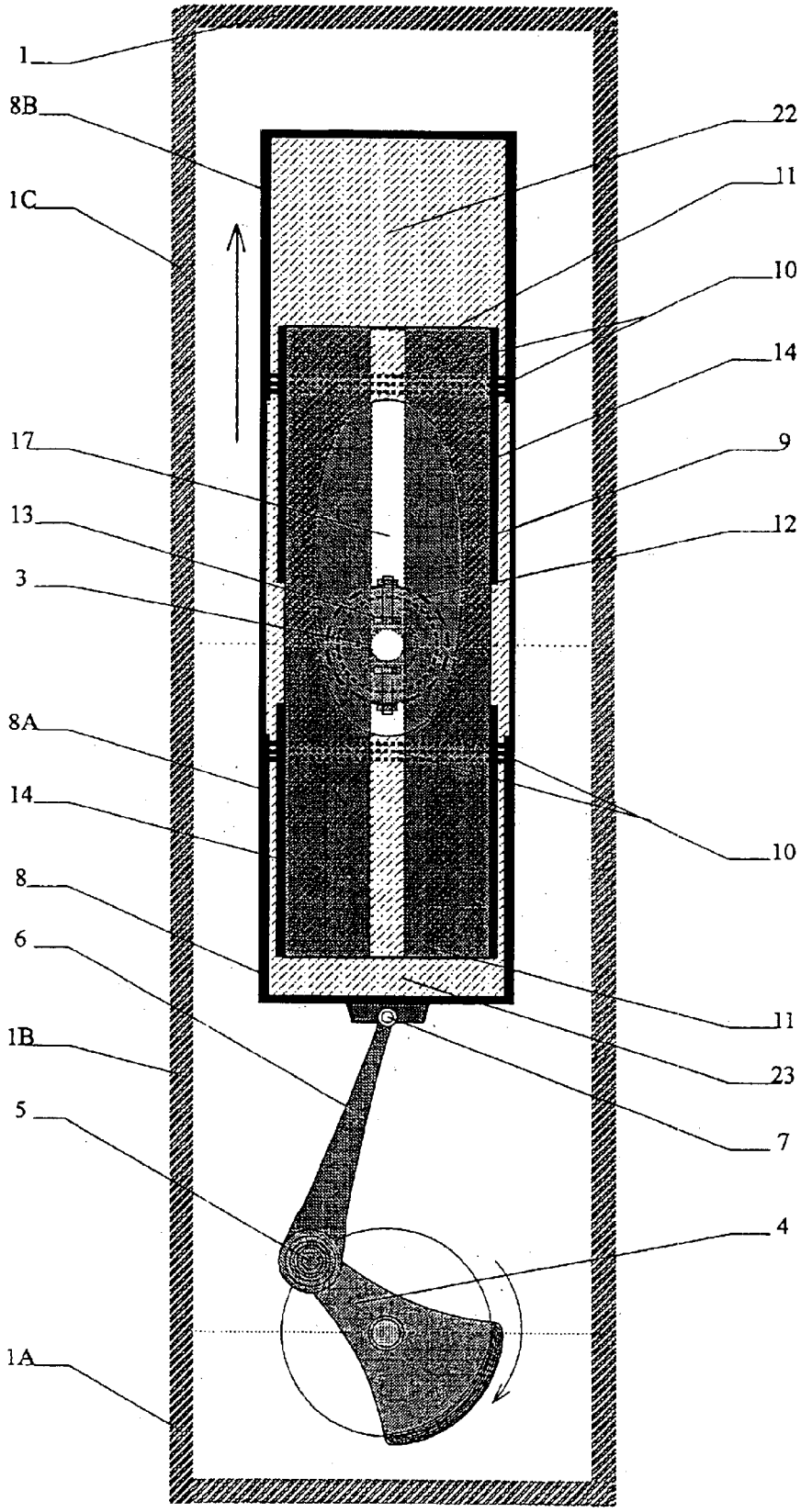
FIG. 3 is a side view of FIG. 1.
Figure 4:
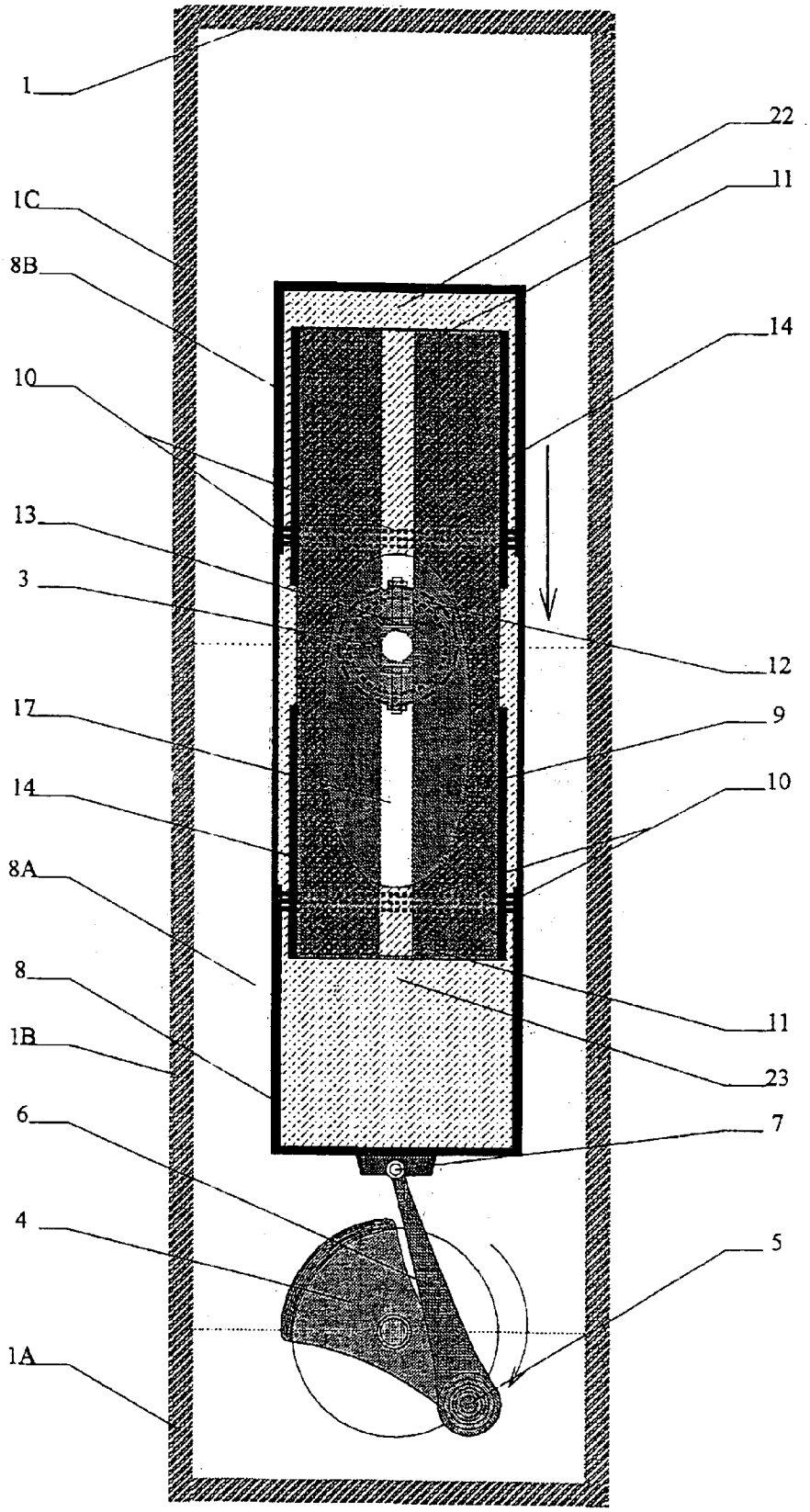
FIG. 4 is a side view of FIG. 2.

As shown in FIGS. 1, 2, 3, 4 in keeping with the first embodiment of the present invention the piston pump comprise a housing 1. The housing of the pump of the present design consists of three parts—back 1A, middle 1B and front 1C. Between parts of the housing there are gaskets (not shown). The parts of the housing are fixed with screws and bolts (not shown). Between the back part 1A and the middle part 1B on both sides of the housing there are seats 2 for crankshaft bearings. Between the middle part 1B and the front part 1C on both sides of the housing there are round-shaped recesses 3 with holes in the middle.

The crankshaft 4 is secured to the seats 2 of the housing through bearings (not shown). The crankshaft 4 is connected through a crank hinge 5, the connecting rod 6 and an axial hinge 7 with the mobile cylinder body 8.

The cylinder body 8 with the opposite cylinders 8A, 8B entering it and made of light metal alloys. Said cylinders are rigidly fixed to each other. Transverse closed parts of said cylinders are situated on their outside ends. On its both sides in the middle part there are oval holes 9. On the inside in the back and front parts there are channel-shaped recesses in the wall that serve for fixing two types of rings 10 (compression and oil-control rings). Inside the opposite cylinders 8A, 8B of the cylinder body 8 there are two stationary opposite pistons 11, which are fixed to each other in the area of their skirts and from there rods 12 passing through holes 9 in the walls of opposite cylinders, are rigidly secured to said housing 1 of the pump with screws and bolts 13 in the recess area 3 of the pump housing. The heads of said pistons are directed outside of each other. Side piston surfaces are working sliding surfaces 14 and made of high-strength steel. Each said piston is made with a suction valve 15 and a discharge valve 16. Inside the pistons two communication parts 17 are laid from the valves which, upon connection, pass through the pipes 18 and 19 from the holes of the lateral recesses 3 of the pump housing to the low pressure source 20 and the high pressure source 21. The working cavities between the corresponding opposite pistons 11 and the internal surface of the opposite cylinders 8A, 8B of the cylinder body 8 represent non-interconnected cylinder chambers. In the present design there are two cylinder chambers—front 22 and back 23.

Principle of operation of the piston pump. External rotary forces are applied to the crankshaft axis and they make the crankshaft 4 rotate. Through the connecting rod 6 the crankshaft rotation leads to the reciprocating movement of the cylinder body 8 with the opposite cylinders 8A, 8B and the reciprocating movement of said cylinders occurs always simultaneously in the same direction. The movement of opposite cylinders relative to fixed opposite pistons 11 which are located inside them brings about the change of capacity and pressure in two cylinder chambers 22, 23. The cylinder body 8 with opposite cylinders 8A, 8B, removing from the crankshaft 4 (See FIGS. 1, 3) increases capacity and reduces pressure in the front cylinder chamber 22. The suction valve 15 opens here, the discharge valve 16 closes. Liquid from the low pressure source 20 fills the front cylinder chamber 22 through the pipe 18 and communication paths 17 laid inside pistons 11. At the same time in the back cylinder chamber 23 capacity reduces and pressure builds up. The discharge valve 16 opens here, the suction valve 15 closes. Pressurized liquid is fed to the high pressure source 21 through communication paths 17 and the pipe 19. When the cylinder body 8 with opposite cylinders 8A, 8B moves in the reverse direction (See FIGS. 2, 4) capacity decreases and pressure increases in the front cylinder chamber 22. The discharge valve 16 here opens, the suction valve 15 closes. Pressurized liquid is fed to the high pressure source 21 through communication paths 17 and the pipe 19. At the same time in the back cylinder chamber 23 capacity increases and pressure decreases. The suction valve 15 here opens, the discharge valve 16 closes. Liquid from the low pressure source 20 fills the back cylinder chamber 23 through the pipe 18 and communication paths 17 laid inside pistons 11. Thus, within one complete revolution of the crankshaft liquid is twice sucked into cylinder chambers from the low pressure source and is supplied under pressure twice to the high pressure source.

Although certain preferred embodiments of the present invention have been shown and described in detail, it should be understood that various changes and modifications may be made therein without departing from the scope of the appended claims.

What is claimed is:

1. A fluid machine comprising a housing and two mobile opposite cylinders fixed rigidly to each other; transverse closed parts of said cylinders are situated on their outside ends; said cylinders carrying out reciprocating movements which occur always simultaneously in the same direction; two stationary opposite pistons are fixed to each other in the area of their skirts and from there rods, passing through holes in the walls of opposite cylinders outside the limits of working cavities, are rigidly secured to said housing; the heads of said pistons are directed outside from each other and made with a suction valve and discharge valve designed to connect non-interconnected working cavities between the corresponding piston and cylinder with low and high pressure sources.

* * * * *